US006102597A

United States Patent [19]

Liberman

[11] Patent Number: 6,102,597

[45] Date of Patent: Aug. 15, 2000

[54] FEED MECHANISM FOR WIDE FORMAT FLEXIBLE SUBSTRATES

[75] Inventor: Boris Liberman, Herzlia, Israel

[73] Assignee: Scitex Wide-Format Division Ltd.

[21] Appl. No.: 09/301,133

[22] Filed: Apr. 28, 1999

[51] Int. Cl.[7] ..... B41J 13/02

[52] U.S. Cl. ..... 400/636.3; 101/636

[58] Field of Search ..... 400/636, 636.3, 400/637, 636.2; 271/273, 274

[56] References Cited

U.S. PATENT DOCUMENTS

| | | | |
|---|---|---|---|
| 978,255 | 12/1910 | Woodward | 400/636 |
| 2,536,525 | 1/1951 | Anderson | 400/636 |
| 3,514,099 | 5/1970 | Miller et al. | 271/51 |
| 5,129,749 | 7/1992 | Sato | 400/639 |
| 5,326,011 | 7/1994 | Mager et al. | 226/181 |

*Primary Examiner*—Ren Yan
*Assistant Examiner*—Darius N. Cone
*Attorney, Agent, or Firm*—Mark M. Friedman

[57] ABSTRACT

A feed mechanism for wide format flexible substrates includes a generally cylindrical traction roller having a first axis of rotation, a traction surface and having a length measured parallel to the first axis at least equal to the maximum width of substrate to be used. A generally cylindrical pressure roller has a second axis of rotation, a pressure surface and has a length measured parallel to the second axis at least equal to the maximum width. The pressure roller is deployed with the second axis parallel to the first axis and the pressure surface in rolling contact with the traction surface. A clamping system is configured to apply clamping forces to the pressure roller so as to press the pressure surface against the traction surface while permitting rotation of the pressure roller about the second axis. The clamping system is configured to apply the clamping forces to the pressure roller at at least three locations spaced along the length of the pressure roller.

10 Claims, 3 Drawing Sheets

FEED MECHANISM FOR WIDE FORMAT FLEXIBLE SUBSTRATES

FIELD AND BACKGROUND OF THE INVENTION

The present invention relates to wide format printers and, in particular, it concerns a feed mechanism for wide format flexible substrates.

It is known to provide wide format printers for printing on wide format flexible substrates such as paper, card, vinyl and other polymers, and textiles. As illustrated in FIG. 1, feed mechanisms for flexible substrates typically employ an arrangement of rollers in which the flexible substrate is driven by friction contact with a traction roller 10. Contact pressure is maintained by a pressure roller 12 which is pressed against the traction roller by a clamping system. The clamping system is generally implemented as pneumatic pistons 14 acting on the axle of pressure roller 12 at its ends.

While very effective for small formats, this type of feed mechanism becomes problematic with wider formats, particularly with widths in excess of about three meters. At these dimensions, slight bending of the rollers leads to significant variations in contact pressure between the rollers from a maximum value at the ends down to a minimum, or even zero, at a central portion. As a result, traction at the central portion of the rollers is reduced or altogether lost, leading to wrinkling of the substrate.

Various approaches have been proposed for improving traction along the rollers. A first approach employs the use of a pressure roller with a diameter which varies along its length so that its central portion bulges slightly outwards. This provides a partial solution, somewhat offsetting the variations in contact pressure along the length of the rollers. This offset, however, is only effective for specific clamping forces, any variation in clamping forces leading again to uneven contact pressure and consequent wrinkling of the substrate.

A second approach, illustrated in FIG. 2, replaces the pressure roller with a number of small pressure wheels 16, each with its own pneumatic piston 14, spaced along the length of traction roller 10. Although this approach ensures sufficient traction for effective feed of the substrate, the narrow pressure wheels generally form visible depressions in the substrate, thereby degrading the output quality.

There is therefore a need for a feed mechanism for wide format flexible substrates which provides effective traction across the width of a traction roller without forming visible depressions in the substrate.

SUMMARY OF THE INVENTION

The present invention is a feed mechanism for wide format flexible substrates.

According to the teachings of the present invention there is provided, a feed mechanism for wide format flexible substrates having a width of up to a given maximum width, the feed mechanism comprising: (a) a traction roller of substantially cylindrical form having a first axis of rotation, a traction surface and having a length measured parallel to the first axis at least equal to the given maximum width: (b) a pressure roller of substantially cylindrical form having a second axis of rotation, a pressure surface and having a length measured parallel to the second axis at least equal to the given maximum width, the pressure roller being deployed with the second axis parallel to the first axis and the pressure surface in rolling contact with the traction surface; and (c) a clamping system configured to apply clamping forces to the pressure roller so as to press the pressure surface against the traction surface while permitting rotation of the pressure roller about the second axis, the clamping system being configured to apply the clamping forces to the pressure roller at at least three locations spaced along the length of the pressure roller.

According to a further feature of the present invention, the clamping system includes at least one intermediate clamping bracket having a pair of clamping wheels in rolling contact with the pressure surface.

According to a further feature of the present invention, the clamping system includes two end brackets associated with ends of the pressure roller.

According to a further feature of the present invention, the end brackets and the at least one intermediate bracket are pivotally mounted so as to be pivotable about a third axis parallel to, but displaced from, the second axis.

According to a further feature of the present invention, the clamping forces are applied substantially independently to the at least three locations via the end brackets and the at least one intermediate bracket.

According to a further feature of the present invention, the pressure roller is configured to be more flexible than the traction roller.

According to a further feature of the present invention, the clamping system includes a plurality of fluid-actuated pistons deployed for providing the clamping forces.

According to an alternative feature of the present invention, the clamping system includes a plurality of mechanical spring elements deployed for providing the clamping forces.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a feed mechanism for wide format flexible substrates.

The principles and operation of feed mechanisms according to the present invention may be better understood with reference to the drawings and the accompanying description.

Figure 3:
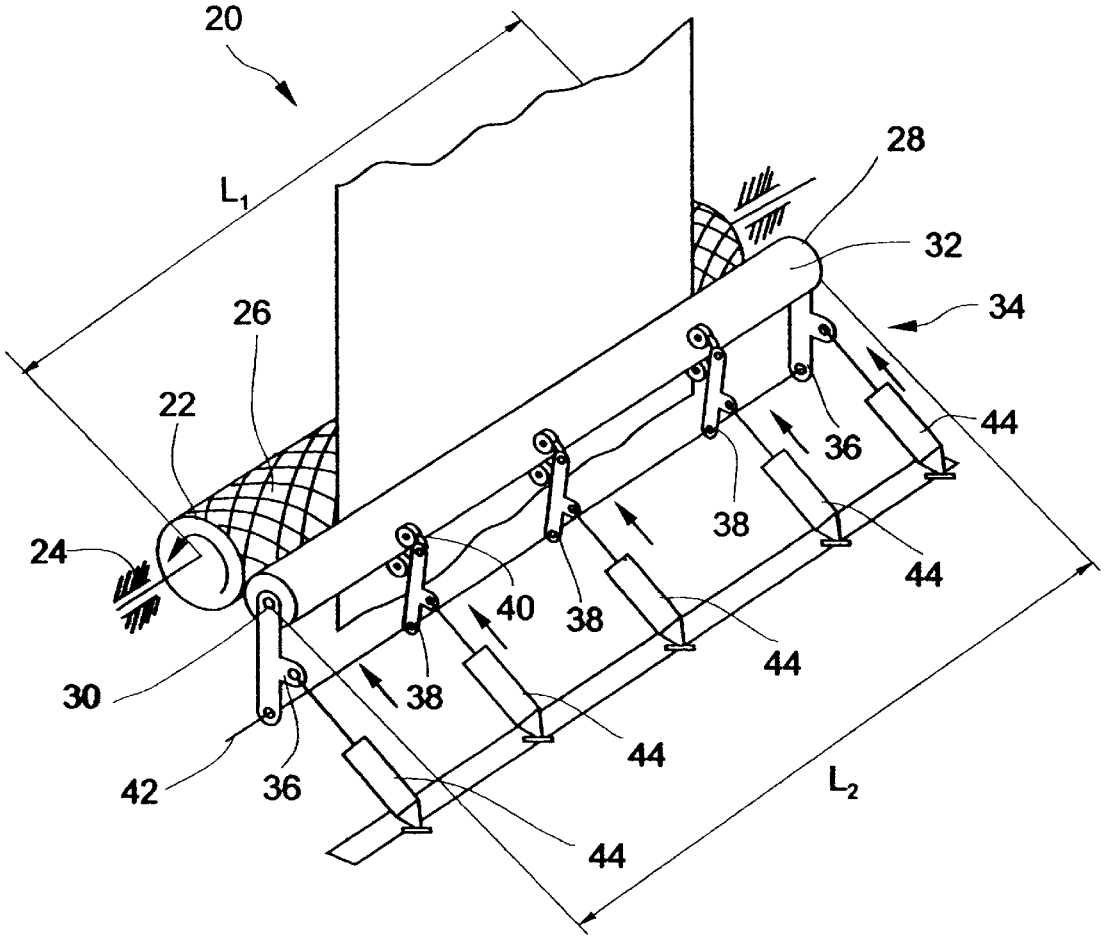
FIG. 3 is a schematic isometric view of a feed mechanism for wide format flexible substrates, constructed and operative according to the teachings of the present invention.

Referring now to the drawings, FIG. 3 shows a feed mechanism, generally designated 20, constructed and operative according to the teachings of the present invention, for feeding wide format flexible substrates.

Figure 1:
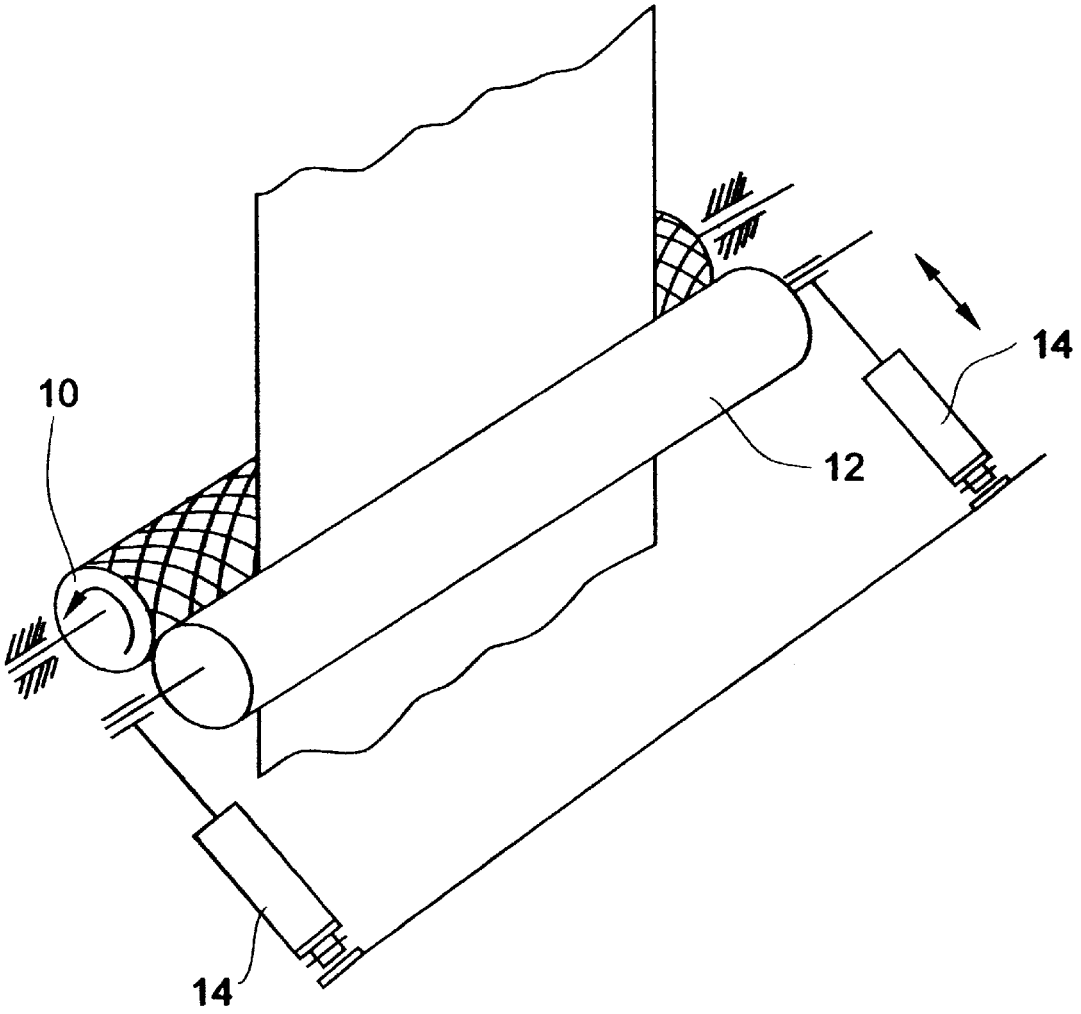
Fig. 1 (Prior Art)
FIG. 1 is a schematic isometric view of a first prior art feed mechanism for wide format flexible substrates.

Generally speaking, feed mechanism 20 is similar to the feed mechanism of FIG. 1, having a traction roller 22 of substantially cylindrical form with a first axis of rotation 24, a traction surface 26 and having a length $L_1$, measured parallel to axis 24, at least equal to a given maximum width of substrate to be fed. Feed mechanism 20 also includes a pressure roller 28 of substantially cylindrical form with a second axis of rotation 30, a pressure surface 32 and having a length $L_2$, measured parallel to the second axis, at least equal to the given maximum width. Pressure roller 28 is deployed with second axis 30 parallel to first axis 24 and with pressure surface 32 in rolling contact with traction surface 26. A clamping system 34 is configured to apply clamping forces to pressure roller 28 so as to press pressure surface 32 against traction surface 26 while permitting rotation of pressure roller 32 about second axis 30.

It is a particular feature of the present invention that clamping system 34 is configured to apply the clamping forces to pressure roller 28 at three or more locations spaced along the length of pressure roller 28.

Figure 2:
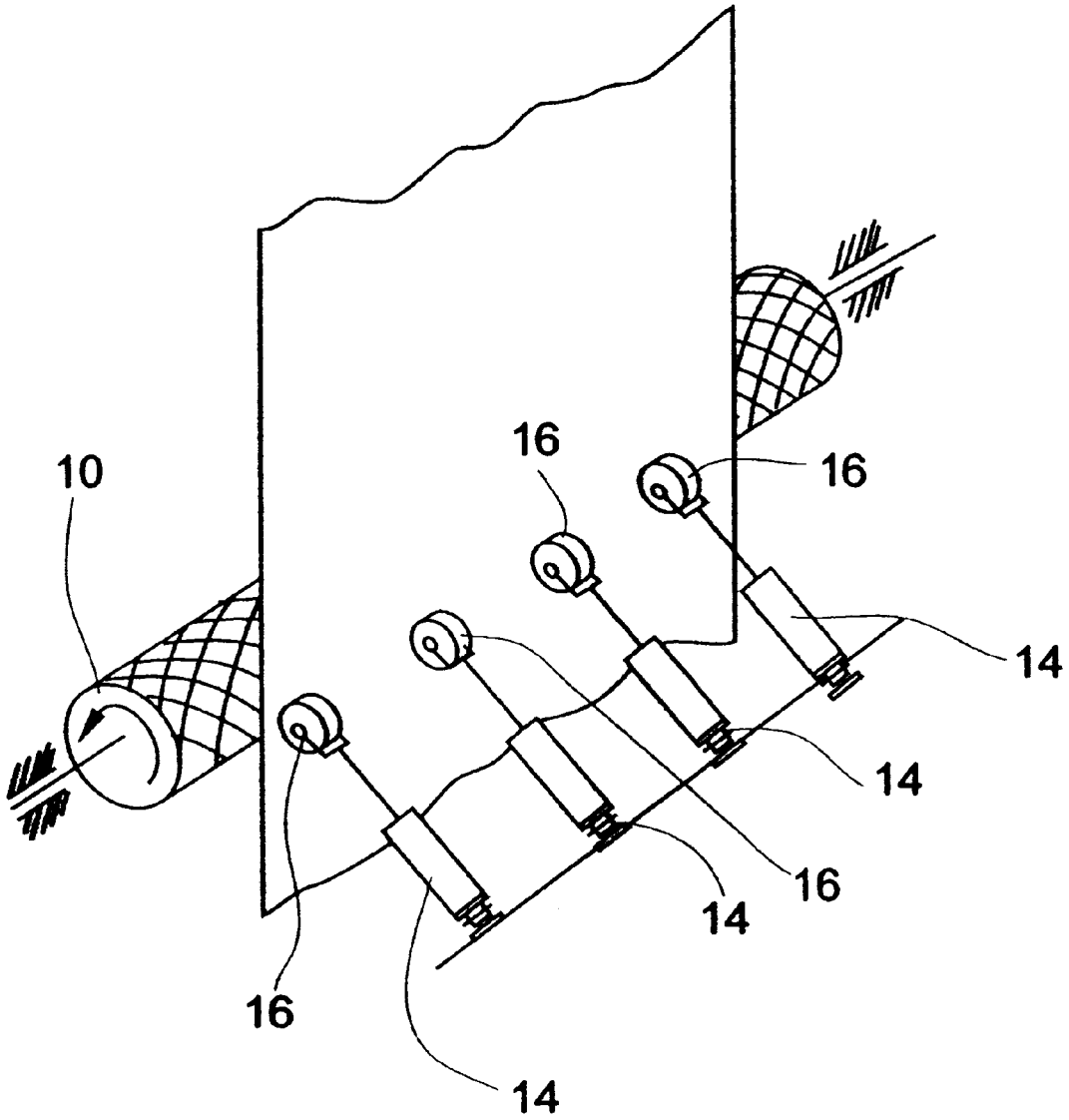
Fig. 2 (Prior Art)
FIG. 2 is a schematic isometric view of a second prior art feed mechanism for wide format flexible substrates.

It will be readily apparent that the present invention provides profound advantages over the known approaches described above with reference to FIGS. 1 and 2. By applying clamping forces at three or more locations along the length of pressure roller 28, effective traction is ensured over a range of clamping forces, thus avoiding the limitations of a "bulging" pressure roller. At the same time, since pressure is applied by a full-length roller, localized depression marks are avoided. These and other advantages of the present invention will be explained further below.

Turning now to the features of feed mechanism 20 in more detail, two of the clamping force transmitting connections of clamping system 34 may advantageously, although not necessarily, be implemented using end brackets 36 associated with ends of pressure roller 28. End brackets 36 typically provide support directly to an axle of pressure roller 28. The remaining one or more clamping force transmitting connections are preferably implemented using at least one intermediate clamping bracket 38 which applies force directly to pressure surface 32 through rolling contact. In a preferred configuration as shown, each clamping bracket 38 employs a pivotally-mounted pair of clamping wheels 40 in rolling contact with pressure surface 32 so as to render alignment of the brackets non-critical.

Preferably, end brackets 36 and intermediate brackets 38 are all pivotally mounted so as to be pivotable about a third axis 42 parallel to, but displaced from, second axis 30. Axis 42 is fixed relative to axis 24, thereby defining the contact geometry of the feed mechanism.

It is a particular feature of most preferred implementations of the present invention that the clamping forces are applied substantially independently to the at least three locations, in this case via end brackets 36 and intermediate brackets 38. In other words, the force applied at each location is preferably substantially independent of the position of, and forces transmitted through, the adjacent brackets. This may conveniently be achieved by providing separate actuator elements for each bracket, or by use of pivoted-fork linkages or the like (not shown) to distribute forces evenly between the brackets.

In one particularly preferred implementation, the clamping forces are provided by a plurality of similar fluid-actuated pistons 44, such as pneumatic pistons, connected to a common fluid supply. This ensures uniform application of force along the length of the rollers. Alternatively, a plurality of mechanical spring elements (not shown) may be deployed to provide the clamping forces.

In a further preferred feature of the present invention, pressure roller 28 is configured to be more flexible than traction roller 22. This allows pressure roller 28 to remain parallel to, and in uniform contact pressure with, traction roller 22, even if the traction roller flexes slightly. This flexibility renders the aforementioned configurations for uniform and independent distribution of clamping forces particularly advantageous.

It will be appreciated that the above descriptions are intended only to serve as examples, and that many other embodiments are possible within the spirit and the scope of the present invention.

What is claimed is:

1. A feed mechanism for wide format flexible substrates which have a width of up to a given maximum width, the feed mechanism comprising:

(a) a traction roller having a first axis of rotation, and providing a continuous cylindrical traction surface having a length measured parallel to said first axis at least equal to the given maximum width;

(b) a pressure roller having a second axis of rotation, and providing a continuous cylindrical pressure surface having a length measured parallel to said second axis at least equal to the given maximum width, said pressure roller being deployed with said second axis parallel to said first axis and said pressure surface in rolling contact with said traction surface; and (c) a clamping system configured to apply clamping forces to said pressure roller so as to press said pressure surface against said traction surface while permitting rotation of said pressure roller about said second axis, said clamping system being configured to apply said clamping forces to said pressure roller at at least three locations spaced along said length of said pressure roller.

2. The feed mechanism of claim 1, wherein said clamping system includes at least one intermediate clamping bracket having a pair of clamping wheels in rolling contact with said pressure surface.

3. The feed mechanism of claim 2, wherein said clamping system includes two end brackets associated with ends of said pressure roller.

4. The feed mechanism of claim 3, wherein said end brackets and said at least one intermediate bracket are pivotally mounted so as to be pivotable about a third axis parallel to, but displaced from, said second axis.

5. The feed mechanism of claim 4, wherein said clamping forces are applied substantially independently to said at least three locations via said end brackets and said at least one intermediate bracket.

6. The feed mechanism of claim 5, wherein said pressure roller is configured to be more flexible than said traction roller.

7. The feed mechanism of claim 1, wherein said clamping forces are applied substantially independently to said at least three locations.

8. The feed mechanism of claim 7, wherein said pressure roller is configured to be more flexible than said traction roller.

9. The feed mechanism of claim 7, wherein said clamping system includes a plurality of fluid-actuated pistons deployed for providing said clamping forces.

10. The feed mechanism of claim 7, wherein said clamping system includes a plurality of mechanical spring elements deployed for providing said clamping forces.

* * * * *